US005450739A

United States Patent [19]

Bogart et al.

[11] Patent Number: 5,450,739

[45] Date of Patent: * Sep. 19, 1995

[54] NEEDLE CURVER WITH AUTOMATIC FEED

[75] Inventors: Michael W. Bogart, Bridgeport; Richard Parente, Milford, both of Conn.

[73] Assignee: United States Surgical Corporation, Norwalk, Conn.

[ * ] Notice: The portion of the term of this patent subsequent to Feb. 14, 2012 has been disclaimed.

[21] Appl. No.: 286,849

[22] Filed: Aug. 5, 1994

Related U.S. Application Data

[63] Continuation of Ser. No. 997,855, Dec. 29, 1992, Pat. No. 5,388,441.

[51] Int. Cl.[6] ..... B21B 39/02

[52] U.S. Cl. ..... 72/133; 72/170; 72/173

[58] Field of Search ..... 72/133, 146, 166, 170, 72/171, 172, 173, 174, 368, 379.2, 379.4, 369, 217; 163/1, 5; 29/9

[56] References Cited

U.S. PATENT DOCUMENTS

| | | |
|---|---|---|
| 1,427,101 | 8/1922 | Gilbert . |
| 1,590,491 | 6/1926 | Beall . |
| 1,666,909 | 4/1928 | Philippi . |
| 1,676,173 | 7/1928 | Wermes . |
| 1,688,099 | 10/1928 | Wagenbach . |
| 1,697,896 | 1/1929 | Yates . |
| 1,702,856 | 2/1929 | Trosch . |
| 2,093,933 | 9/1937 | Sinclair . |
| 2,309,963 | 2/1943 | Krueger . |
| 2,353,925 | 7/1944 | Pattison . |
| 2,457,705 | 12/1948 | Moran . |
| 2,579,858 | 12/1951 | Price . |
| 2,647,743 | 8/1953 | Cook . |
| 2,722,261 | 11/1955 | Bishop . |
| 2,739,763 | 3/1956 | Silfverlin et al. . |
| 2,756,803 | 7/1956 | Faeber . |
| 2,937,821 | 5/1960 | O'Brien . |
| 2,990,001 | 6/1961 | Hansen . |
| 3,038,475 | 6/1962 | Orcutt . |
| 3,040,798 | 6/1962 | Johnson . |
| 3,064,711 | 11/1962 | Fuchs, Jr. . |
| 3,112,087 | 11/1963 | Fornataro . |
| 3,279,229 | 10/1966 | Lagher . |
| 3,326,025 | 6/1967 | Nishioka . |
| 3,357,222 | 12/1967 | Konstandt . |
| 3,444,716 | 5/1969 | Martin . |
| 3,456,321 | 7/1969 | Furt et al. . |
| 3,608,347 | 9/1971 | Kemminer . |
| 3,704,616 | 12/1972 | Taira . |
| 3,808,863 | 5/1974 | Marcovitch . |
| 3,937,052 | 2/1976 | Hoexter et al. . |

(List continued on next page.)

FOREIGN PATENT DOCUMENTS

| | | |
|---|---|---|
| 109905 | 5/1984 | European Pat. Off. . |
| 109906 | 5/1984 | European Pat. Off. . |
| 2385462 | 10/1978 | France . |
| 63-73989 | 4/1988 | Japan . |
| 63-309338 | 12/1988 | Japan . |
| 3-118050 | 5/1991 | Japan . |
| 0054818 | 6/1943 | Netherlands . |

OTHER PUBLICATIONS

Patent Abstracts of Japan, vol. 16, No. 107, Publication No. JP 3281025, Dec. 1991.

Patent Abstracts of Japan, vol. 10, No. 155 (M-485), Jun. 1986.

Patent Abstracts of Japan, vol. 13, No. 392, Publication No. JP 1138030, May 1989.

Japan Abstract No. 61-9927(A) dated Jan. 17, 1986.

*Primary Examiner*—S. Thomas Hughes

[57] ABSTRACT

An apparatus for forming curved surgical needles is provided which includes a needle curving system for imparting an arcuate profile to sequentially presented needle blanks and a rotating system for pressing the needle blank against the curving system. The apparatus also includes needle supply and advancing systems for sequentially feeding and advancing the needle blanks to the needle curving system.

12 Claims, 13 Drawing Sheets

U.S. PATENT DOCUMENTS 3,994,656 11/1976 Van Ausdall ..... 425/391
4,040,283 8/1977 Suriano .
4,063,442 12/1977 Martin, Sr. .
4,145,904 3/1979 Giros et al. ..... 72/142
4,312,208 1/1982 Schäfer .
4,346,577 8/1982 Peters et al. .
4,524,771 1/1985 McGregor et al. .
4,633,698 1/1987 Oetiker .
4,702,097 10/1987 Zahlaus .
4,777,816 10/1988 Inoue .
5,041,127 8/1991 Troutman .
5,287,721 2/1994 Samsel ..... 163/5 X
5,323,633 6/1994 Bogart et al. ..... 163/1 X

NEEDLE CURVER WITH AUTOMATIC FEED

This is a continuation of U.S. application Ser. No. 07/997,855 filed Dec. 29, 1992, now U.S. Pat. No 5,388,441.

BACKGROUND OF THE INVENTION

1. Field of the Invention

The present invention relates to needle curving devices. More particularly, the invention relates to a rotating needle curving device for sequentially curving a multiplicity of needles.

2. Description of the Related Art

The production of needles involves many processes and different types of machinery in order to prepare quality needles from raw stock. These varying processes and machinery become more specialized in the preparation of surgical needles where the environment of intended use is in humans or animals. Some of the processes involved in the production of surgical grade needles include, inter alia: straightening spooled wire stock, cutting needle blanks from raw stock, tapering or grinding points on one end of the blank, providing a bore for receiving suture thread at the other end of the blank, flat pressing a portion of the needle barrel to facilitate easier grasping by surgical instrumentation, and curving the needle where curved needles are desired. Conventional needle processing is, in large part, a labor intensive operation requiring highly skilled workmen. Generally, extreme care must be taken to ensure that only the intended working of the needle is performed and the other parts of the needle remain undisturbed.

Curved needles have advantages over other needle configurations in many surgical procedures for a variety of reasons including, uniformity of entry depth for multiple sutures and proper "bite" of tissue surrounding the incision or wound. When providing curved needles for surgical procedures it is desirable for the needles to have a specified curvature, i.e., a predetermined radius of curvature. The predetermined radius of curvature for the needle varies with specific applications and the size of the needle.

Conventional needle curving techniques create the curve by manually forming the machined needle around an anvil structure having a desired curvature. To attain the desired needle configuration, the anvil structure provides a shaping surface for forming the needle. Typically, the needle in positioned for curving by manually holding the needle in engagement with the anvil structure with a holding device. The needle is subsequently bent by manually manipulating the holding device so the needle curvature is formed about the shaping surface of the anvil structure.

When needles are made of steel or similar resilient materials, the anvil or mandrel used may have a smaller radius than the radius desired in the final needle. This configuration allows for some springback after the bending operation and ensures that the desired radius of curvature is attained. A disclosure of such features may be found in, for example, U.S. Pat. No. 4,534,771 to McGregor et al.

One disadvantage to conventional needle curving techniques is that only one needle can be curved around an anvil structure at a time. Another disadvantage is that the needle is manually positioned for engagement about the anvil surface. Lastly, the incidence of needle damage during the curving process is relatively high due to the manual placement and bending of the needle.

One way to overcome the above drawbacks is described in commonly assigned U.S. patent application Ser. No. 07/958,926 to Bogart, filed Oct. 9, 1992. Bogart is primarily directed to automatically curving a multiplicity of needle blanks simultaneously via reciprocating rollers. The present invention provides an alternate way to address the above mentioned drawbacks by providing a system which sequentially presents needle blanks for curving via rotating at least one roller about a mandrel.

SUMMARY OF THE INVENTION

The present invention provides an apparatus for forming curved surgical needles which comprises curving means for imparting an arcuate profile to at least a portion of a needle blank and rotating means for pressing the needle blank about the curving means. The apparatus also provides needle advancing means for receiving the needle blank in a needle presenting station and for advancing the needle blank to a needle curving station while needle supply means sequentially supplies needle blanks to the needle presenting station.

In the preferred embodiment, the curving means comprises a mandrel adapted to selectively engage at least a portion of the needle blank. Generally, the mandrel is a shaft having at least a portion thereof configured to impart an arcuate profile to the needle blank. Preferably, the shaft has a curvature with a predetermined radius in the range of between about 0.050 inches and about 0.500 inches.

In one configuration, the rotating means of the present invention comprises at least one rotatable member and means for rotating the rotatable member about at least a portion of the curving means.

Needle advancing means are also provided and comprise at least one pair of rollers with belt means positioned therebetween for supporting the needle blank and advancing the needle blank between the at least one pair of rollers to the needle curving position. Preferably, the belt means comprises an elastic belt formed of a material selected from the group consisting of Neoprene, Nylon, Polyurethane or poly(p-phenylene terephthalamide) also known as KEVLAR TM and belt drive means for driving the elastic belt.

Tensioning means may be provided for applying tension to the belt means. Appropriate tensioning means include at least one tensioning roller biased toward the belt means.

The needle supply means of the present invention preferably comprises clamping means for releasably maintaining the needle blanks, means for sequentially advancing the clamping means toward the needle presenting position, sensing means for sensing the needle blank in the needle presenting position and means for selectively ejecting the needle blanks from the clamping means. The clamp advancing means may be configured as a power screw operatively connected to clamp drive means. The ejecting means comprises a pusher head slidably secured to pusher head drive means and a pusher pin secured to and extending from the pusher head.

The present invention also provides a method for forming curved surgical needles. The method includes the steps of providing means for forming curved needles, positioning the needle blank between curving means and at least one rotatable member and activating rotating means to form the curvature in the needle blank. Preferably, the forming means comprises a mandrel having a curvature with at least one predetermined radius for selectively engaging at least a portion of a needle blank, the at least one rotatable member, and the means for rotating said rotatable member about at least a portion of the mandrel.

BRIEF DESCRIPTION OF THE DRAWINGS

Preferred embodiments of the invention are described hereinbelow with reference to the drawings wherein.

DETAILED DESCRIPTION OF PREFERRED EMBODIMENTS

Generally, the needle curving apparatus of the present invention is utilized to curve or bend a multiplicity of sequentially presented needle blanks. As used herein the term "needle blank" refers to a surgical needle in various stages of fabrication. Typically, the needle blanks are flat pressed on two sides prior to curving. Thus, in the preferred embodiment of the present invention, the needle blank is curved along the pressed sides.

Figure 1:
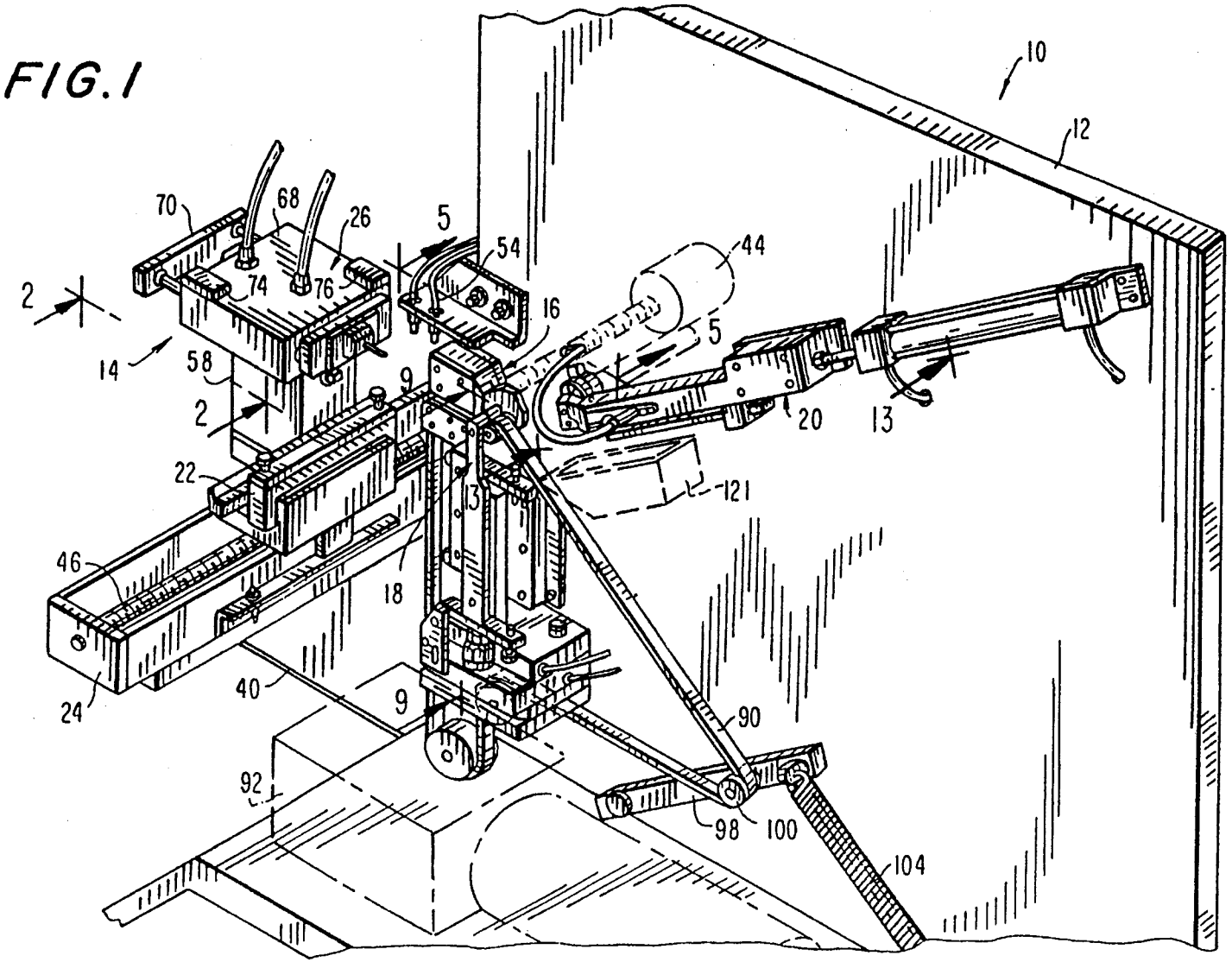
FIG. 1 is a perspective view of a needle curving apparatus in accordance with one embodiment of the present invention.

Referring now in detail to the drawings, in which like reference numerals identify similar or identical elements throughout the several views, FIG. 1 illustrates a preferred needle curving apparatus 10 of the present invention. The needle curving apparatus 10 includes frame 12, needle supply system 14, needle advancing system 16, needle curving system 18, and needle recovery system 20. A control system (not shown) is provided to control the operational sequence of the needle curving apparatus of the present invention. An example of a suitable control system includes a GE-Fanuc 9030 Programmable Controller, a LCD display manufactured by Horner Electric and numerous control switches and indicators.

Figures 2, 2A:
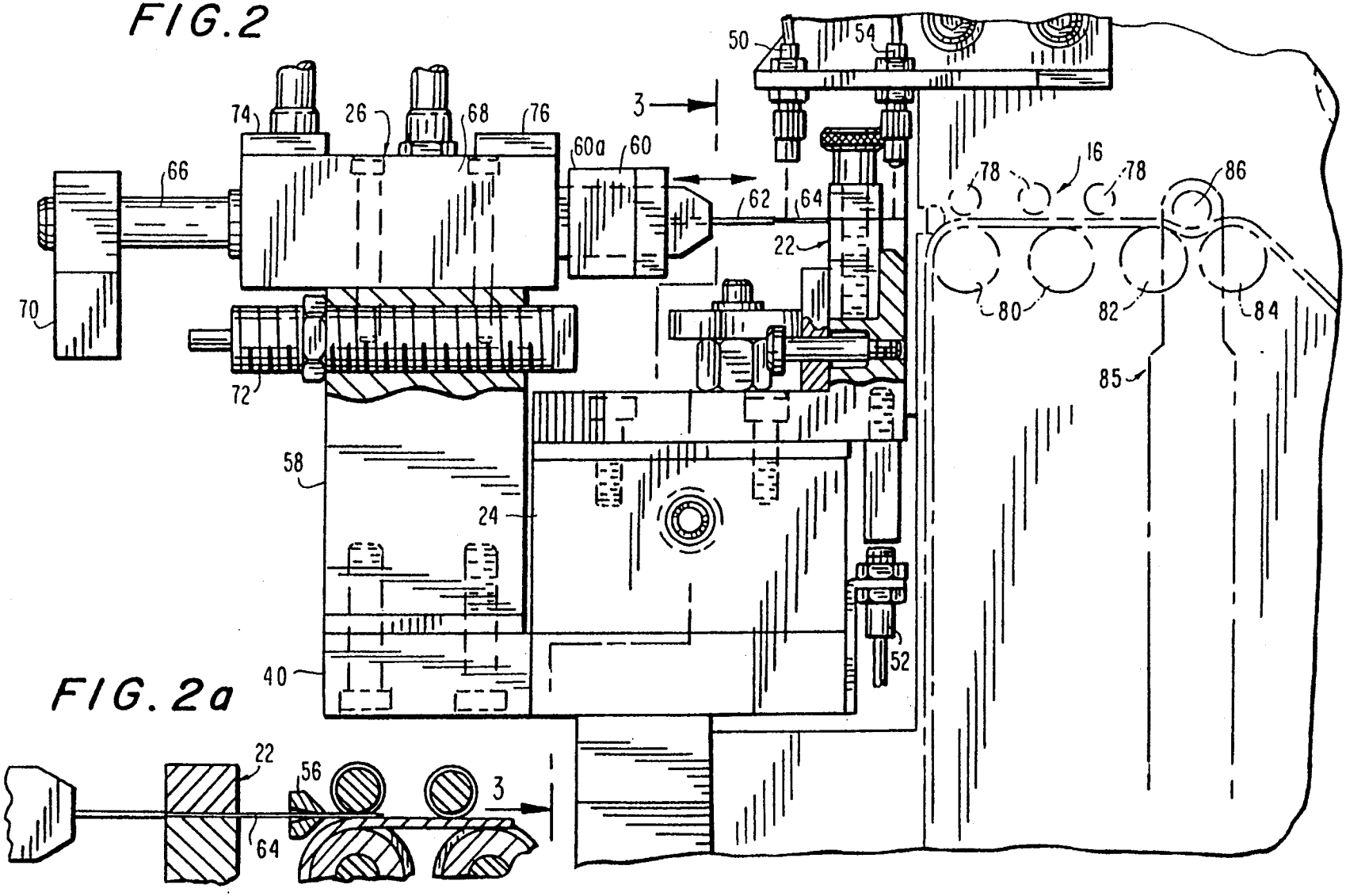
FIG. 2 is a side elevational view of the needle supply system of the present invention taken along line 2—2 of FIG. 1, illustrating needle blanks clamped within the needle clamp with a pusher pin engaging a needle blank in the needle presenting position.
FIG. 2*a* is an enlarged side elevational view in partial cross-section of the pusher pin ejecting a needle blank from the needle clamp.
Figures 3, 4:
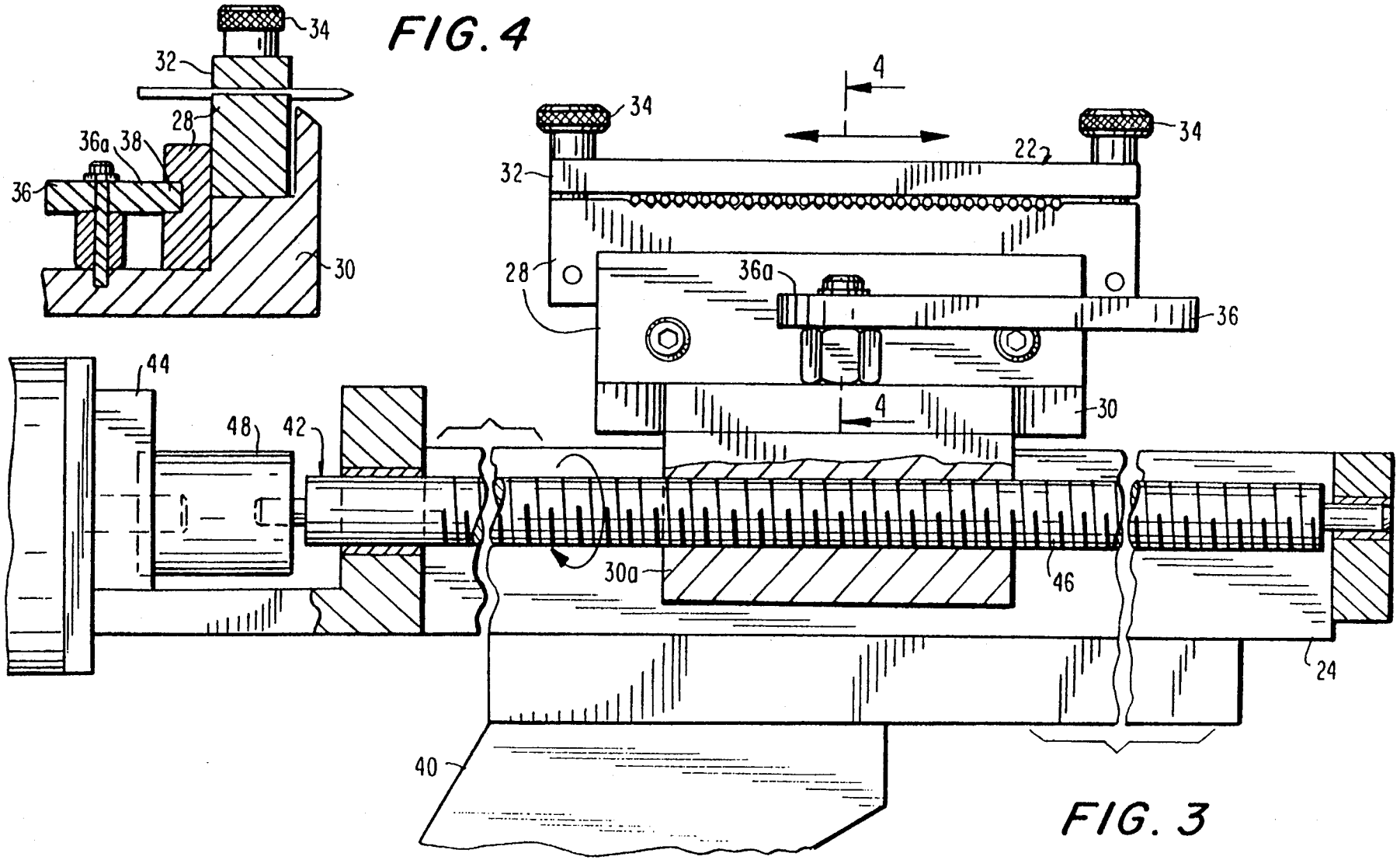
FIG. 3 is a partial cross-sectional view of a portion of the needle supply system taken along line 3—3 of FIG. 2, illustrating the needle clamp and the associated power screw.
FIG. 4 is a cross-sectional view of the needle clamp taken along line 4—4 of FIG. 3.

Referring to FIGS. 2, 2A, 3 and 4, needle supply system 14 includes needle clamp 22 which is slidably secured to power screw frame 24 and needle pusher assembly 26. Generally, as shown in FIG. 3, needle clamp 22 is a two piece member having base 28 which is removably secured to rack 30 and removable top 32 which is secured to base 28 by thumb screws 34. The joint between top 32 and base 28 is configured, dimensioned and adapted to receive and releasably maintain a plurality of needle blanks in a row and oriented such that the longitudinal axis of each needle blank is substantially perpendicular to the longitudinal axis of clamp 22, as shown in FIG. 3. Preferably, base 28 is removably secured to rack 30 by locking arm 36, as shown in FIG. 4. Locking arm 36 is rotatably secured to rack 30 so that one end portion 36*a* of locking arm 36 engages channel 38 of base 28 when locking arm 36 is rotated clockwise (best seen in FIG. 4). When locking arm 36 is rotated counter-clockwise, end portion 36*a* of the locking arm is disengaged from channel 38 of base 28, thus releasing the base from the rack.

Figure 5:
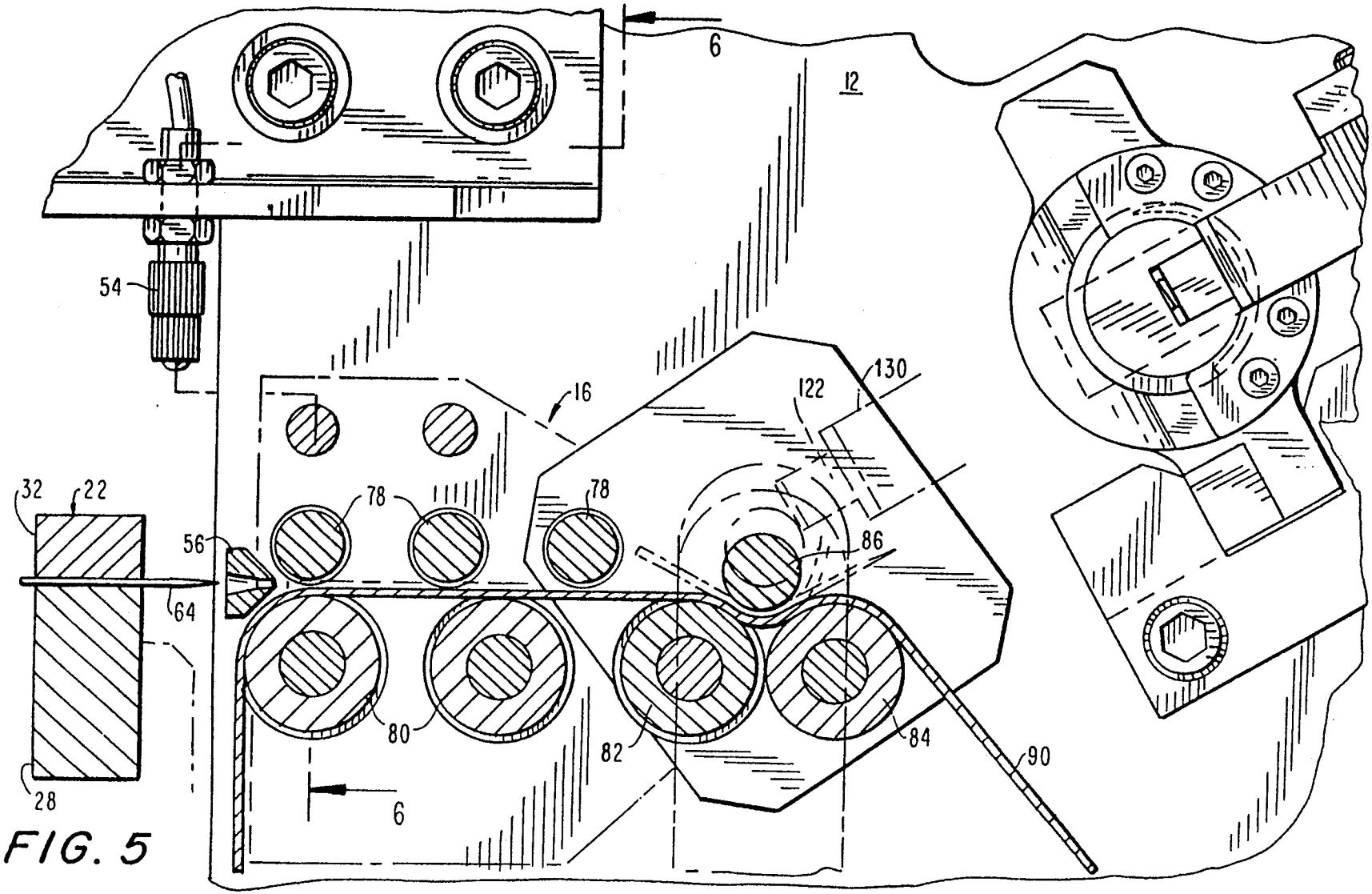
FIG. 5 is a side elevational view of a portion of the needle advancing system of the present invention taken along line 5—5 of FIG. 1.

Referring to FIGS. 1 and 3, power screw frame 24 is secured to frame 12 by bracket 40 and supports power screw assembly 42 and needle clamp assembly 22. Power screw assembly 42 includes drive member 44 and threaded rod member 46 rotatably positioned within power screw frame 24. Preferably, rod member 46 is threaded through base portion 30*a* of rack 30 which has an internal thread dimensioned to receive threaded rod member 46. In addition, threaded rod member 46 is operatively connected to drive member 44 by coupler 48 so that rotational movement of drive member 44 is transferred through rod member 46 which translates to linear sliding movement of needle clamp 22. Drive member 44, preferably a stepper motor, is operatively connected to the control system and responds to sensors 50, 52 and 54, shown in FIG. 2. Optical sensors 52 (preferably there are two but only one is shown) are secured to each end portion of power screw frame 24, and serve to limit the distance the rack and the needle clamp can move along the power screw frame. In this configuration, needle clamp 22 can traverse the longitudinal axis of power screw frame 24 so as to sequentially position the needle blanks in the needle presenting station. The needle presenting station is the position of the needle blank in needle clamp 22 which aligns with needle guide 56 of needle advancing system 16, as shown in FIG. 5.

Referring to FIGS. 2 and 2A, needle pusher assembly 26 is provided to sequentially eject needle blanks from needle clamp 22 into needle advancing system 16. Needle pusher assembly 26 is secured to post 58 and includes a forward portion having pusher head 60 and pusher pin 62 extending from pusher head 60. Needle pusher assembly 26 is positioned on bracket 40 so that pusher pin 62 aligns with the needle blank 64 in the needle presenting station. Movement of pusher pin 62 toward needle clamp 22 will push or eject the needle blank from clamp 22 into needle advancing system 16. The rear portion 60*a* of pusher head 60 is connected to piston 66 which extends through pusher drive assembly 68 into engagement with limit arm 70.

Preferably, the pusher drive assembly is a pneumatically controlled drive member capable of driving an internal piston between an extended position and a retracted position, which coincides with the above described movement of pusher head 60. However, the pusher drive assembly may be any other known drive system, such as, for example, an electric motor or a hydraulic cylinder.

Limit switch 72 is secured to post 58 and is operatively connected to the control system so as to disable pusher head 60 when the needle blank has been ejected from needle clamp 22. Magnetic sensors 74 and 76 are secured to pusher drive assembly 68 and are operatively connected to the control system. Sensors 74 and 76 are provided to sense whether pusher head 60 is in the extended position (i.e., ejecting a needle blank from the needle clamp) or in the retracted position (i.e., behind the needle blank in the needle presenting position) and are activated when either limit arm 70 or pusher head 60 are in close proximity to corresponding magnetic sensor 74 or 76. Optical sensors 50 and 54 are secured to frame 12 and operatively connected to the control system. Optical sensor 50 is provided to determine when the next needle blank is in the needle presenting position and optical sensor 54 is provided to determine when the needle blank has been fully ejected from clamp 22.

Figure 6:
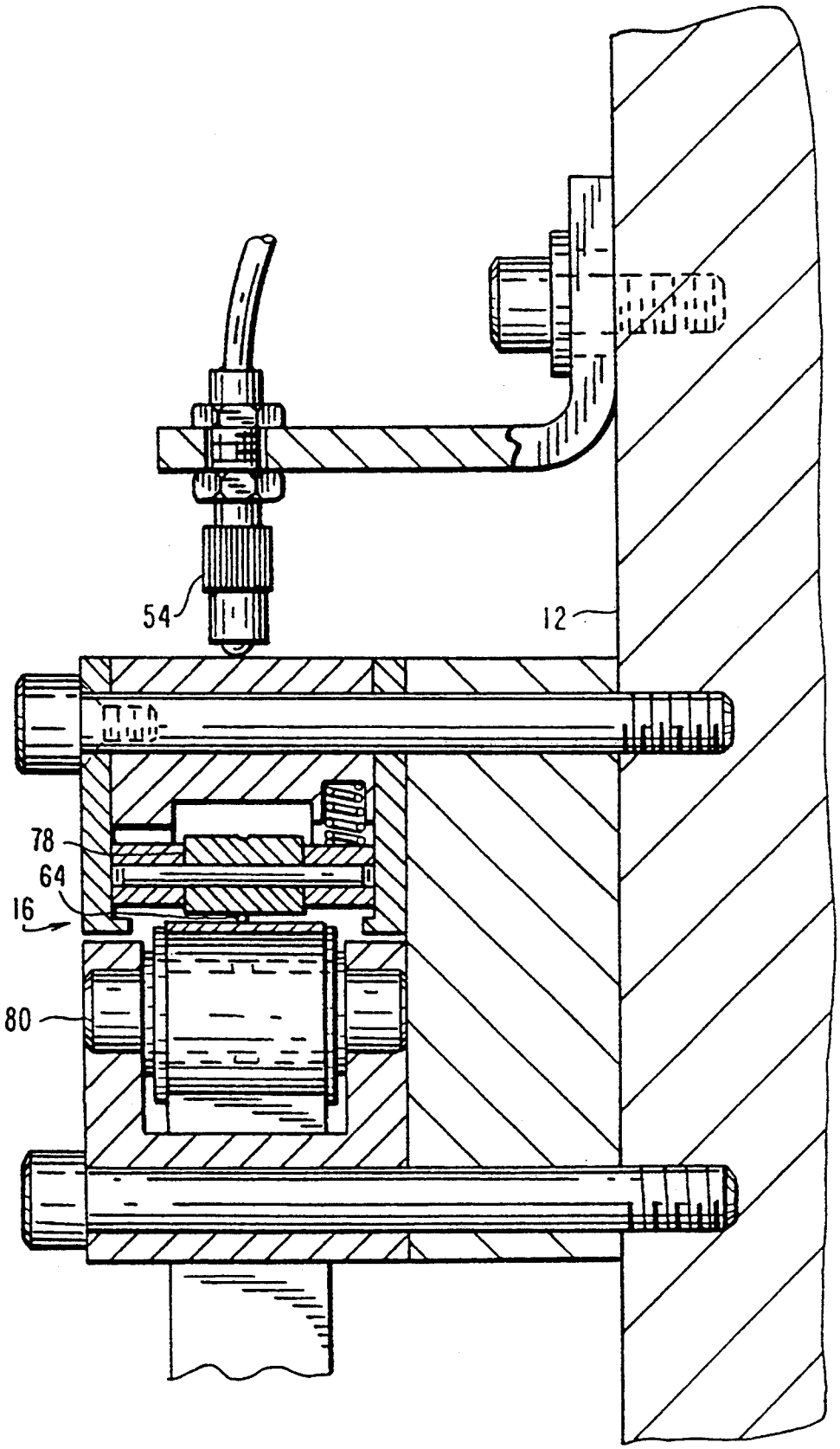
FIG. 6 is a partial cross-sectional view of a portion of the needle advancing system taken along line 6—6 of FIG. 5, illustrating the entry of the needle blank into the advancing system.

Referring now to FIGS. 1, 5 and 6, needle advancing system 16 includes upper guide rollers 78 and lower guide rollers 80 rotatably secured to frame 12. Rollers 78, 80 are spatially positioned to provide a smooth transfer of the needle blank from the needle presenting position to the needle curving station. The needle curving station (or needle shaping zone) is the position of the needle blank when it is adjacent to positioning roller 82, curving roller 84 and mandrel 86 for subsequent bending.

Figure 7:
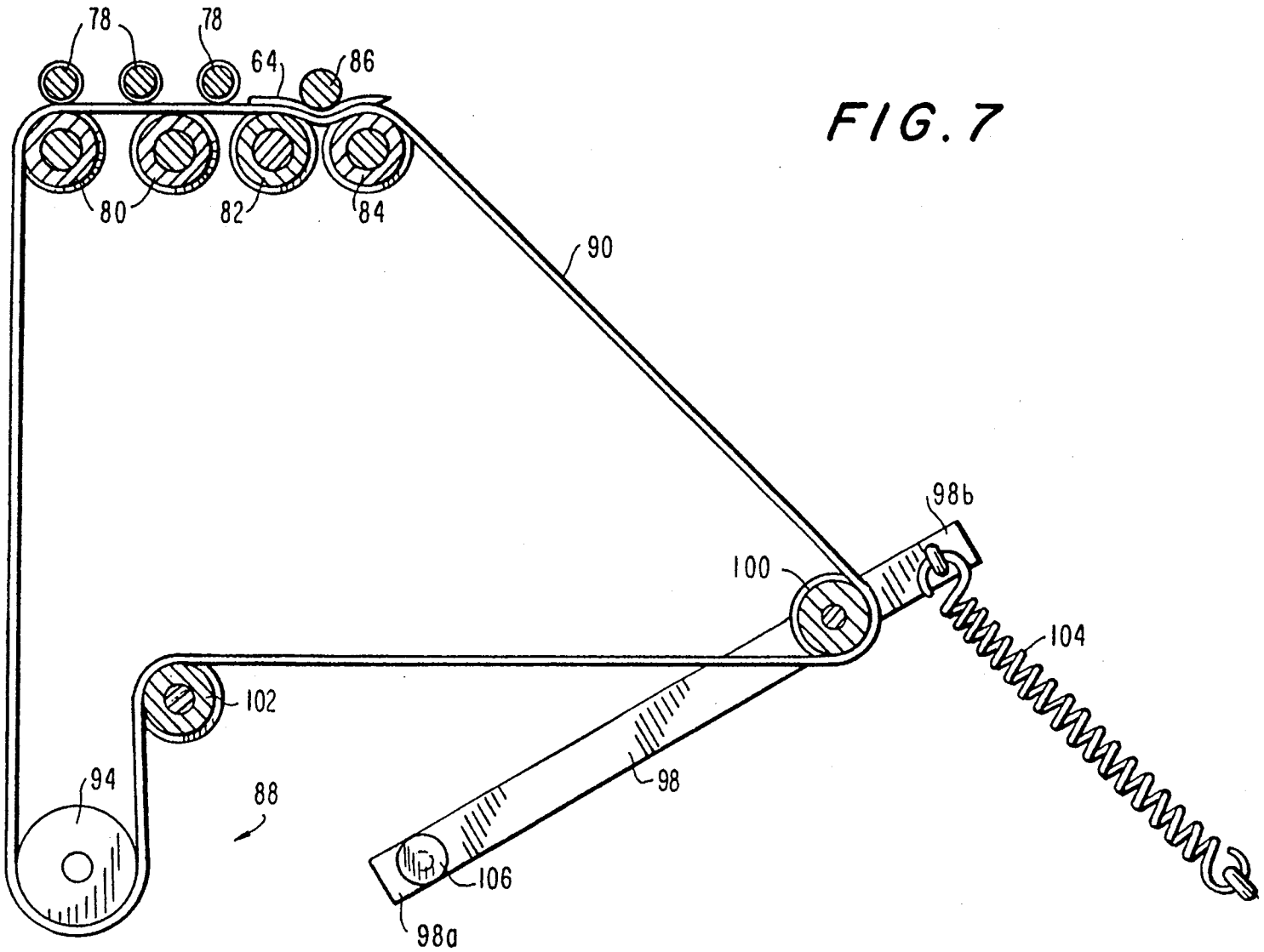
FIG. 7 is a side elevational view of the needle advancing system, the needle curving system and the belt tensioning system of the present invention.
Figure 8:
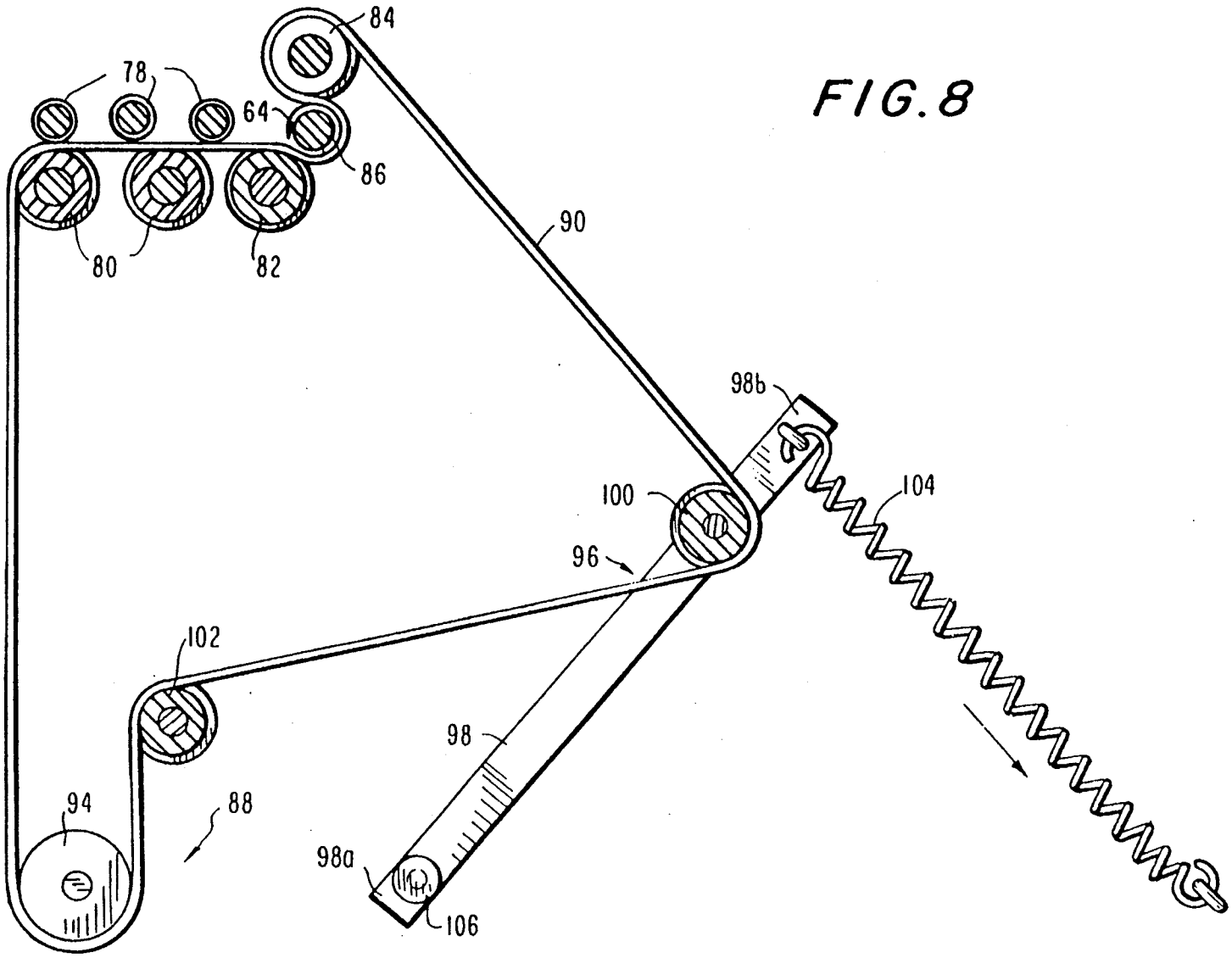
FIG. 8 is a side elevational view similar to FIG. 7, illustrating a curving roller being rotated about a mandrel.

Referring to FIGS. 1, 7 and 8, belt drive system 88 includes drive belt 90, drive belt motor 92 and drive shaft 94 which is coupled to motor 92. Preferably, drive belt 90 is a closed loop belt which is routed between upper guide rollers 78 and lower guide rollers 80 and around drive shaft 94 in a tight frictional fit. As a result, rotational movement of drive shaft 94 is transferred to rotational movement of drive belt 90 and lower guide rollers 80. Preferably, drive belt 90 is fabricated from a material which is sufficiently flexible to wrap about lower guide rollers 80 and drive shaft 94 in a friction fit, and of sufficient strength to assist in bending needle blanks about the mandrel without damaging the needle blanks. For example, the drive belt may be fabricated from elastomeric material having a durometer value between about 80 and about 90, such as neoprene, nylon, polyurethane, poly(p-phenylene terephthalamide) also known as KEVLAR TM and the like. However, other systems may be utilized to rotate the guide rollers. For example, a roller system (not shown) may be provided to transfer rotational movement of the drive shaft to the guide rollers.

Upper guide rollers 78 are provided to maintain the needle blank in a frictional relationship with drive belt 90 without substantially deforming or marring the needle blank. Preferably, upper and lower guide rollers 78 and 80 are molded and ground into a cylindrical shape from a material having a hardness value substantially equivalent to the hardness value of the needle material. Rollers 78 and 80 are then coated with an elastomeric material such as a polyurethane to form a protective layer having sufficient thickness to ensure good frictional contact with drive belt 90 or the needle blank and to help prevent marring of the needle blank. The thickness of the coating on rollers 78 and 80 may be in the range of between about one sixty-fourth of an inch and about one eighth of an inch.

Belt tensioning system 96 is provided to maintain the tension on belt 90 during the operation of the needle curving apparatus of the present invention. Preferably, belt tensioning system 96 includes idler arm 98, idler rollers 100 and 102 and spring 104. One end portion 98*a* of idler arm 98 is pivotally secured to frame 12 by pin 106. Idler roller 100 and spring 104 are secured to the other end portion 98*b* of idler arm 98. Roller 100 which is rotatably secured to the idler arm, and spring 104 are provided to create sufficient downward force on idler arm 98 so as to maintain the proper tension on drive belt 90 during the curving operation, as shown in FIGS. 7 and 8. Idler roller 102 is rotatably secured to frame 12 in close proximity to drive shaft 94 so as to further increase the tension of drive belt 90.

Referring now to FIGS. 5 and 7–12, the needle shaping or curving system in accordance with this preferred embodiment of the present invention will now be described. The needle curving system 18 includes positioning roller 82, curving roller 84 and mandrel assembly 85 to impart an arcuate profile to the needle blank. However, other known types of needle shaping systems may be utilized to impart a predetermined configuration to the needle blank. Such predetermined configurations include, but are not limited to, angular configurations such as an "L" shaped needle.

Figure 9:
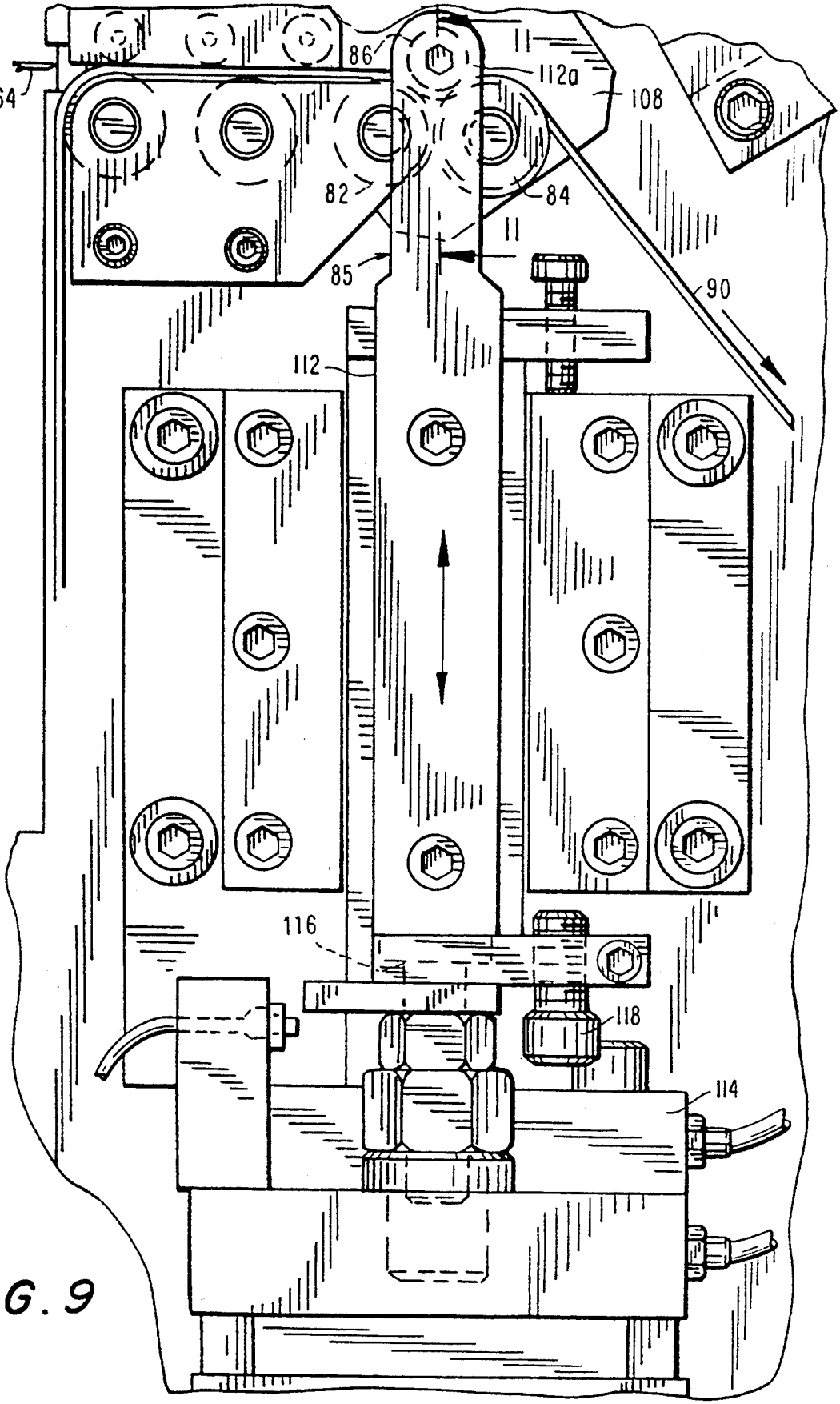
FIG. 9 is a side elevational view of the mandrel assembly of the present invention taken along line 9—9 of FIG. 1, illustrating the mandrel in the open position.
Figure 11:
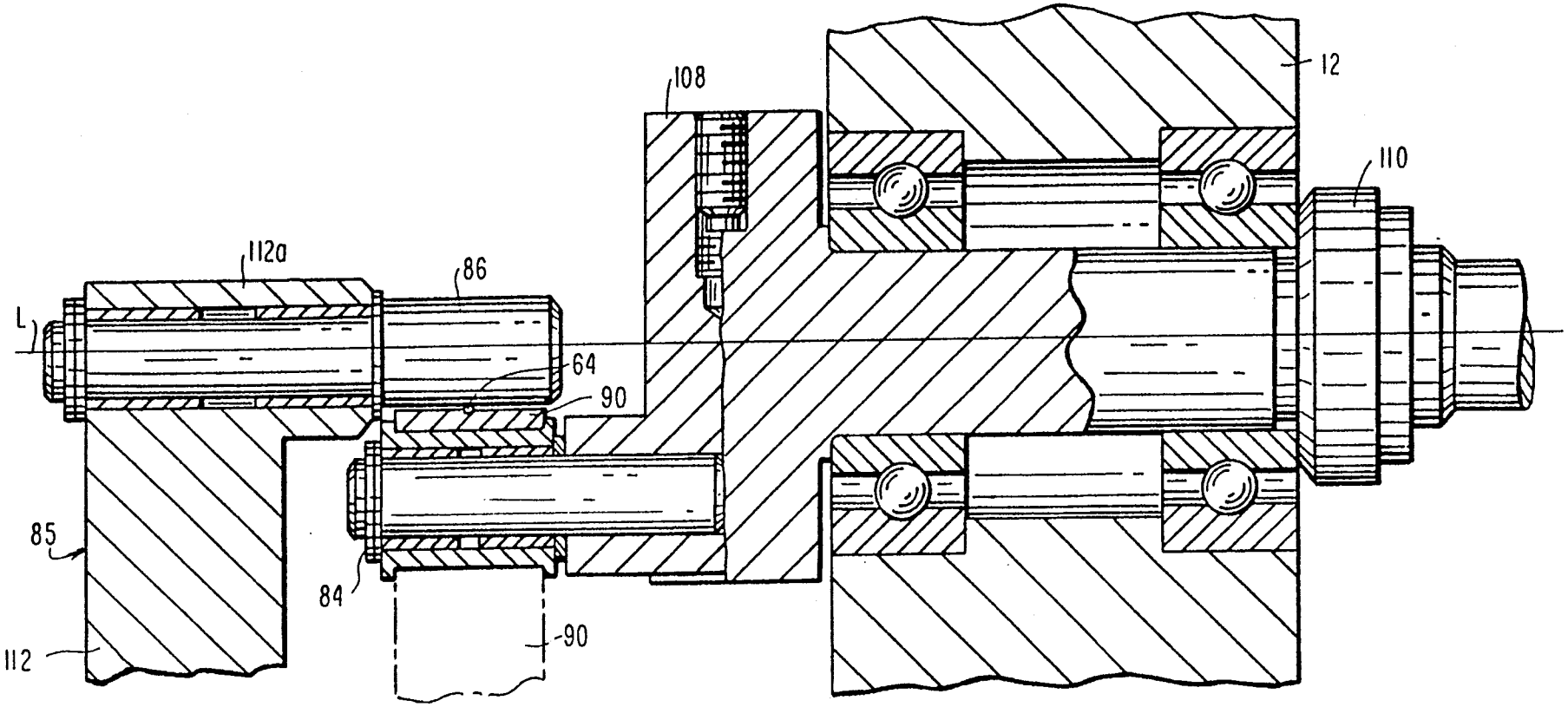
FIG. 11 is partial cross-sectional view of the rotating needle curving member taken along line 11—11 of FIG. 9.

Positioning roller 82 is rotatably secured to frame 12 adjacent to curving roller 84, as shown in FIG. 9. Curving roller 84 is secured to rotating bracket 108 which passes through frame 12 and engages bracket drive 110, as shown in FIG. 11. In this configuration, curving roller 84 can rotate about mandrel 86 to bend the needle blank upon actuation, as shown in FIG. 8. Preferably, rollers 82 and 84 are molded and ground and coated with an elastomeric material similar to lower and upper guide rollers described above. The thickness of the coating on rollers 82 and 84 may be in the range of between about one sixty-fourth of an inch and about one eighth of an inch.

Figure 10:
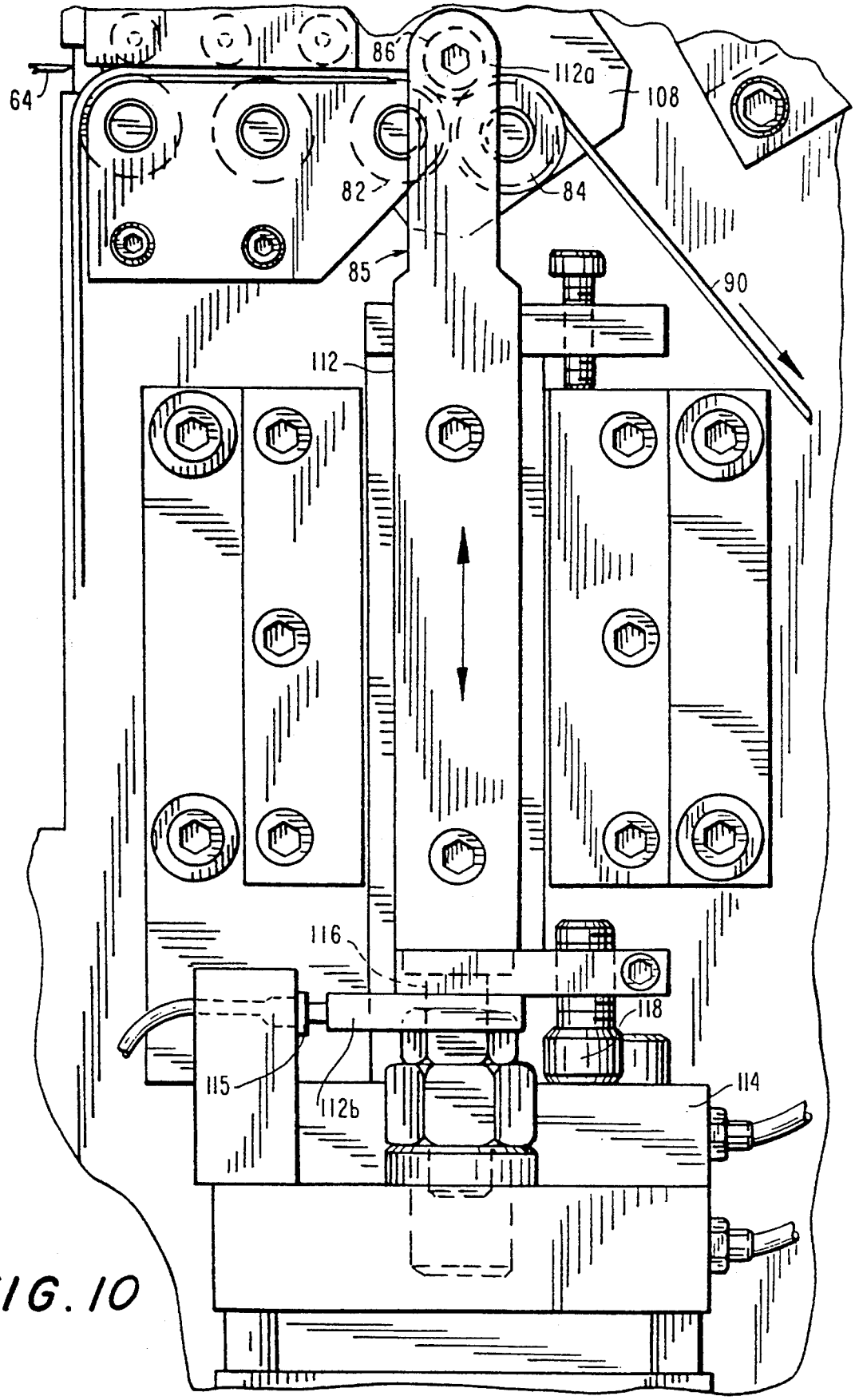
FIG. 10 is a side elevational view of the mandrel assembly similar to FIG. 9 illustrating the mandrel in the deforming position.

Referring to FIGS. 9 and 10, mandrel assembly 85 includes mandrel 86, mandrel arm 112 and mandrel drive member 114. Mandrel drive member 114 is secured to frame 12 and includes piston 116 which is secured to mandrel arm 112. Mandrel drive member 114 is provided to reciprocate mandrel drive arm 112 between an open position and a deforming position. In the open position, shown in FIG. 9, piston 116 is extended such that mandrel 86 is displaced from rollers 82 and 84 a sufficient distance to allow the needle blank to enter the needle curving station. In the deforming position, shown in FIG. 10, piston 116 is retracted causing mandrel 86 to deform the needle blank and maintain the needle blank in a tight frictional fit between rollers 82 and 84 and drive belt 90. The downward movement of mandrel arm 112 is limited by mandrel limit arm 118 so as to ensure proper positioning of the mandrel between rollers 82 and 84. Preferably, mandrel drive member 114 is a pneumatic cylinder, however, the drive member may be any other known drive system, such as an electric motor or a hydraulic cylinder.

In a preferred embodiment, mandrel 86 is positioned adjacent to positioning roller 82 and curving roller 84 in a triangular orientation so that the center axis of mandrel 86 aligns with the center axis of bracket drive member 110, as identified by line "L" in FIG. 11. In this configuration rotational movement of curving roller 84 is centered around mandrel 86 to ensure even curvature of the needle blank.

Mandrel 86 is a shaft or rod transversely secured to one end portion 112*a* of mandrel arm 112. Preferably, mandrel 86 has a solid cross-section and is fabricated from a material having a hardness which is at least substantially equal to the hardness of the needle material. Typically, mandrel 86 has a Rockwell hardness value between 55C and about 57C which discourages unwanted shaping or marring of the needle blank and/or the mandrel. In addition, mandrel 86 may be coated with an elastomer material to help prevent unwanted marring of the needle blank and/or mandrel 86 during the curving process.

Preferably, the mandrel has a circular cross-section to impart an arcuate profile to the needle blank resulting in a curved surgical needle having a predetermined radius of curvature of between about 0.050 inches and about 0.500 inches. However, surgical needles requiring different arcuate profiles require various shaped mandrels, such as elliptical, triangular, rectangular or pear-shaped mandrels which impart a predetermined curvature to the needle blank.

The diameter of the preferred circular mandrel is dependent on numerous factors including the length of the needle blank, the desired radius of curvature and the spring back characteristics of the needle blank material, i.e., the tendency of the needle material to return to its original shape after being deformed. To illustrate, larger diameter mandrels produce a large radius of curvature and smaller diameter mandrels produce a smaller radius of curvature. Further, in instances where the needle blank is fabricated from a material having spring back tendencies, the mandrel diameter should be smaller than the desired radius of curvature so that,the needle will spring back to the desired radius of curvature after bending. The apparatus of the present invention is configured to accommodate mandrels with various diameters necessary for curving surgical needles of various sizes.

It is also preferred that drive belt 90 be positioned between mandrel 86 and rollers 82 and 84 so as to prevent marring of the needle blank and to assist in the curving of the needle blank, as shown in FIGS. 7 and 8. Thus, when curving roller 84 is rotated about mandrel 86, drive belt 90 is pulled with an upward force causing idler arm 98 to pivot upwardly. However, tension is maintained on drive belt 90 via spring 104, as noted above.

Figure 13:
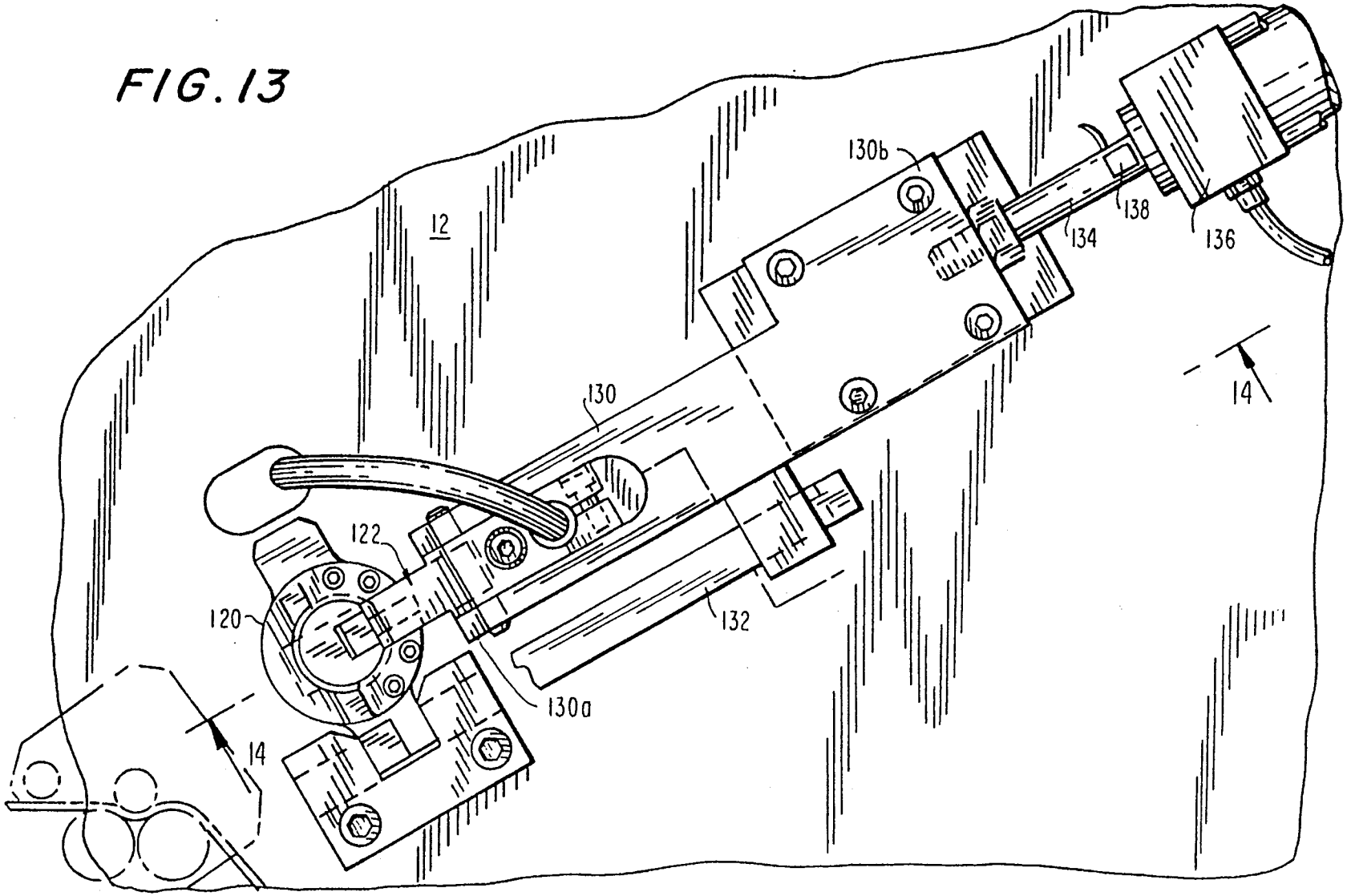
FIG. 13 is a side elevational view of the needle recovery system of the present invention taken along line 13—13 of FIG. 1.
Figure 14:
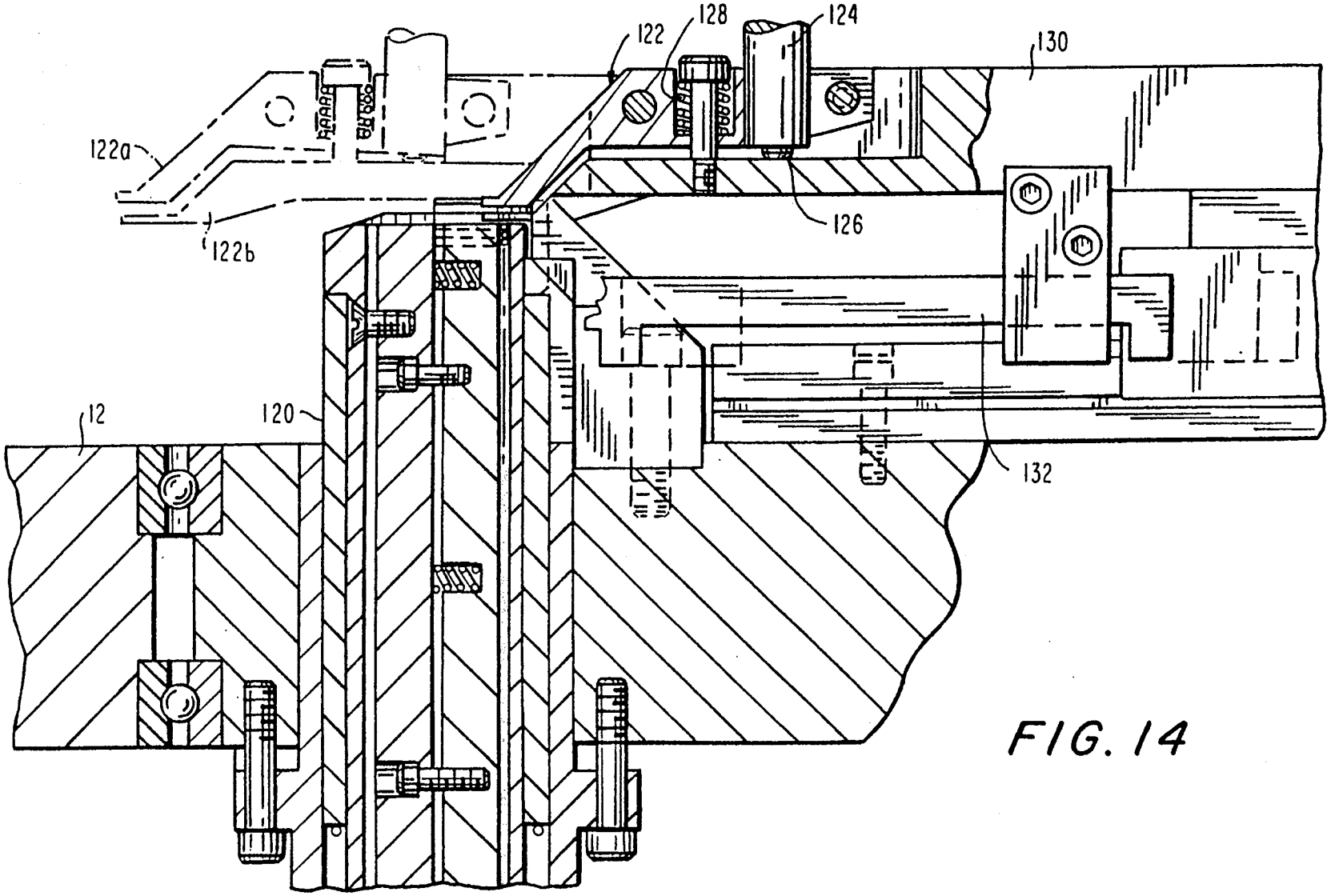
FIG. 14 is a partial cross-sectional view of a portion of the needle recovery system taken along line 14—14 of FIG. 13.

Referring now to FIGS. 13 and 14, the needle recovery system 20 of the present invention will now be described. Needle recovery system 20 includes needle retainer 120 and needle gripper 122. Needle retainer 120 is secured to frame 12 and is positioned so that needle grippers 122 slide through a portion thereof so as to deposit the newly curved needle into retainer 120. Needle gripper 122 includes a pair of jaws 122*a* and 122*b*, shown in FIG. 14, which are biased together by gripper actuator 124. Preferably, gripper actuator 124 is a pneumatically controlled cylinder which retracts piston 126 to allow jaws 122*a* and 122*b* to close under the biasing action of spring 128. Extension of piston 126 causes jaws 122*a* and 122*b* to open, as shown in FIG. 14.

Needle gripper 122 is secured to the forward portion 130*a* of needle gripping arm 130, as shown. Needle gripping arm 130 is slidably secured to frame 12 via slide track 132 and has a rear portion 130*b* secured to piston 134 of gripper drive member 136. Gripper drive member 136, preferably a pneumatic cylinder, causes needle gripper 122 and needle gripper arm 130 to move between a needle pick-up position, and a needle depositing position. The needle pick-up position is the position where needle gripper 122 is adjacent rollers 82 and 84 and mandrel 86 so as to grasp the newly curved needle blank, shown in FIG. 5. The needle depositing position is the position where needle gripper 122 deposits the newly curved needle either into retainer 120, shown in FIG. 13, or into a hopper 121, shown in phantom in FIG. 1. Piston sensor 138, preferably a magnetic sensor, is mounted to piston 134 so that when piston 134 retracts (i.e, the needle gripper is in the needle depositing position) sensor 138 is in close proximity to gripper drive member 136 and activates. The control system responds to activation of sensor 138 by causing the next needle in needle clamp 22 to be ejected from the clamp and advanced through the needle advancing system as described above.

In operation, the needle blanks are initially loaded into needle clamp 22, however, since the needle clamp is removably secured to rack 30, needle blanks may be pre-loaded into the needle clamp during another needle manufacturing process. Thus, the initial step in curving the needle blanks may simply be to install a pre-loaded needle clamp on the needle curving apparatus of the present invention, as described above. As mentioned above, the needle blank is preferably flat pressed prior to curving, therefore, the needle blanks should be inserted in the clamp with one flat portion facing down to ensure that the curve is formed along the pressed sides of the needle blank.

Once the needle blanks are properly installed, the power screw assembly 42 is activated until optical sensor 50 senses that a needle blank is in the needle presenting station. The needle pusher assembly 26 is then activated, via the control system, so that pusher pin 62 of pusher head 60 ejects the needle blank from needle clamp 22 into the needle advancing system 16. Once optical sensor 54 senses that the rear portion of the needle blank has been ejected (i.e., sensor 54 no longer detects the presence of that portion of the needle blank) the needle advancing system is activated for a period of time sufficient to allow the needle blank to advance to the needle curving station. The time duration to advance the needle blanks is dependent on various design parameters of the apparatus, such as, the speed of the stepper motor which rotates the drive belt, the diameter of the rollers and the frictional forces of the needle blank passing between the rollers. For example, if a 1.00 inch needle blank is being curved the time duration to advance the needle blank to the needle curving station is about 25 ms.

Figure 12:
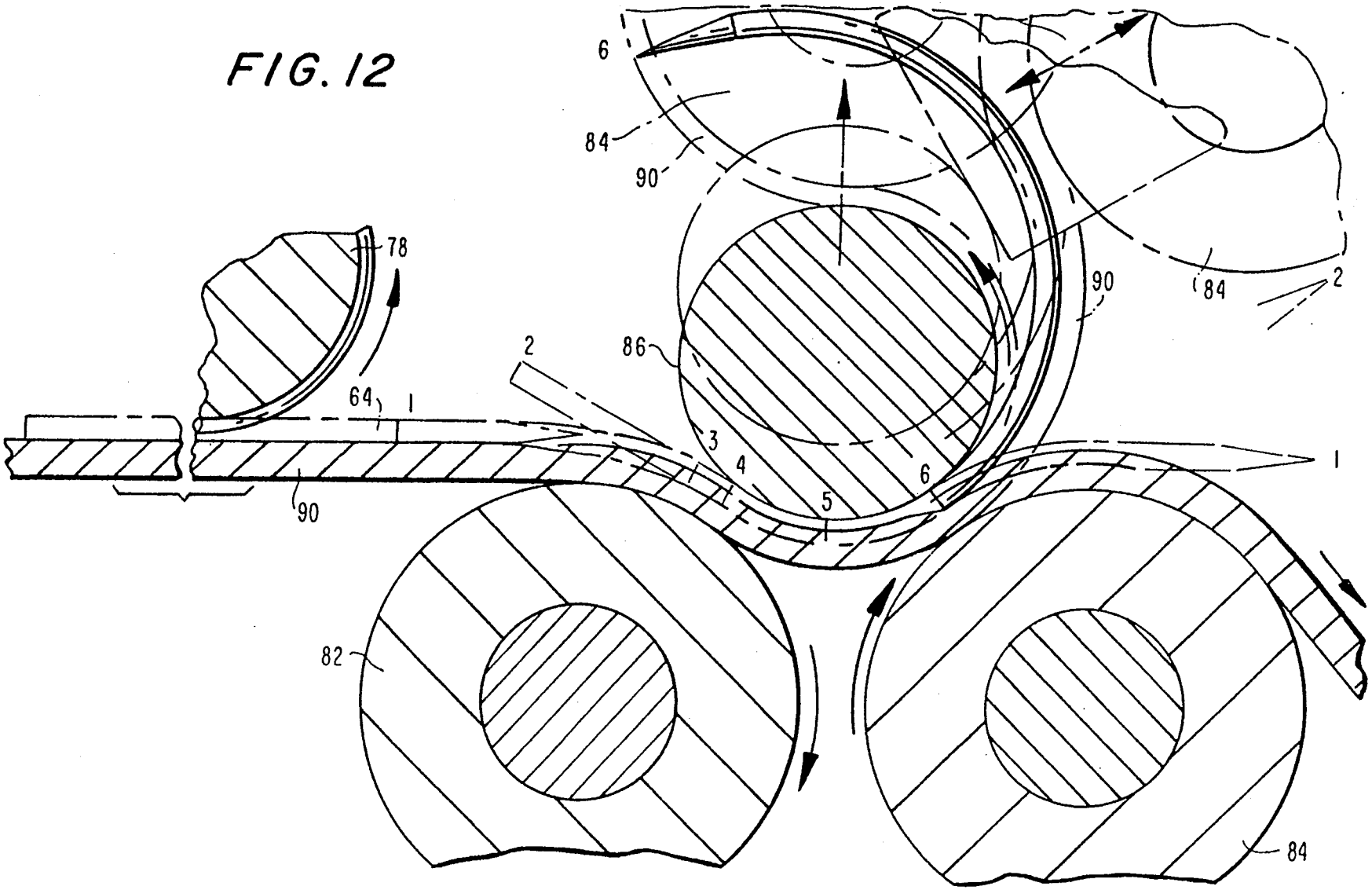
FIG. 12 is an enlarged side elevational view of the needle shaping zone of the present invention, illustrating the needle blank after curving and the needle recovery system gripping the needle.

When in the needle curving station, mandrel 86 moves downwardly a predetermined distance so as to engage the needle blank and at least partially deform the needle blank, as shown in FIG. 5. Downward movement of mandrel 86 continues until mandrel limit arm 118 abuts the upper surface of mandrel drive member 114. Optical sensor 115 of mandrel assembly 85 senses mandrel arm portion 112*b*, causing the control system to activate bracket drive member 110. This bracket drive member 110 rotates curving roller 84 about mandrel 86, thus imparting the arcuate profile to the needle blank, as shown in FIGS. 8 and 12. Simultaneously with the activation of bracket drive member 110, the control system also activates the needle advancing system which moves the needle blank about mandrel while curving roller 84 is being rotated about the mandrel.

Once curved, the needle blank is then retrieved by needle recovery system and either inserted into retainer 120 or dropped into hopper 121. When gripper arm 130 is returned to the needle depositing position, magnetic sensor 138 is activated causing the control system to restart the cycle, as described above. This process is repeated until all the needle blanks in the needle clamp have been ejected therefrom.

It will be understood that various modifications can be made to the embodiments of the present invention herein disclosed without departing from the spirit and scope thereof. Therefore, the above description should not be construed as limiting the invention but merely as exemplifications of preferred embodiments thereof. Those skilled in the art will envision other modifications within the scope and spirit of the present invention as defined by the claims appended hereto.

What is claimed is:

1. An apparatus for forming curved surgical needles comprising:

a needle advancing member configured to receive a needle blank in a needle presenting position and advance the needle blank to a needle curving position;

a needle blank curving member having a center axis and configured to impart a predetermined arcuate profile to at least a portion of a needle blank; and a needle blank pressing member rotatable about said center axis of said needle blank curving member, to press the needle blank about at least a portion of said needle blank curving member so as to impart said predetermined arcuate profile to the needle blank.

2. The apparatus according to claim 1 further comprising a needle supply mechanism to sequentially supply needle blanks to said needle presenting position.

3. The apparatus according to claim 2 wherein said needle blank curving member comprises a curving shaft having at least a portion configured to impart said predetermined arcuate profile to the needle blank.

4. The apparatus according to claim 3 wherein said portion of said curving shaft configured to impart said arcuate profile has a predetermined radius in the range of between about 0.050 inches and about 0.500 inches.

5. The apparatus according to claim 3 wherein said needle blank pressing member comprises:

at least one pressing shaft in substantial parallel alignment with said curving shaft and rotatable about said center axis of said curving shaft; and a drive member connected to said at least one pressing shaft to rotate said needle blank pressing member about at least a portion of said curving shaft when a needle blank is positioned between said shafts.

6. An apparatus for forming curved surgical needles, which comprises:

a needle blank curving member having a center axis and configured to impart a predetermined arcuate profile to at least a portion of a needle blank; and a needle blank pressing member rotatable about said center axis of said needle blank curving member and configured to press the needle blank about at least a portion of said needle blank curving member so as to impart said predetermined arcuate profile to the needle blank.

7. The apparatus according to claim 6 wherein said needle blank curving member comprises a curving rod having a diameter of between about 0.050 inches and about 0.500 inches.

8. The apparatus according to claim 7 wherein said needle blank pressing member comprises a pressing rod in substantial parallel alignment with said curving rod and configured to selectively move around a portion of an outer surface of said curving rod to impart said predetermined arcuate profile to the needle blank.

9. An apparatus for forming curved surgical needles comprising:

a needle advancing member configured to receive a needle blank and advance the needle blank to a needle curving position;

a curving, shaft having a center axis;

at least one pressing member in substantial parallel alignment with said curving shaft and rotatable about said center axis of said curving shaft; and a drive member connected to said at least one pressing member to rotate said needle blank pressing member about at least a portion of said curving shaft when a needle blank is positioned between said shaft and said member, whereby at least a portion of the needle blank is pressed about at least a portion of said curving shaft so as to impart a predetermined arcuate profile to the needle blank.

10. The apparatus according to claim 9 wherein said needle blank curving shaft comprises a curving rod having a diameter of between about 0.050 inches and about 0.500 inches.

11. The apparatus according to claim 9 further comprising a needle supply mechanism to sequentially supply needle blanks to said needle advancing member.

12. A method for forming curved surgical needles comprising:

positioning a needle blank intermediate a curving shaft having a center axis and a pressing member in substantial parallel alignment with said curving shaft; and rotating said pressing member about said center axis of said curving shaft such that said needle blank is pressed between said curving shaft and said pressing member to impart a predetermined arcuate profile to said needle blank.

* * * * *